US012017829B2

(12) United States Patent
Horz

(10) Patent No.: US 12,017,829 B2
(45) Date of Patent: Jun. 25, 2024

(54) CONTAINER HAVING A SUPPORTING STRUCTURE BETWEEN A CLOSURE MEMBRANE AND LID

(71) Applicant: Ardagh MP Group Netherlands B.V., Deventer (NL)

(72) Inventor: Peter Horz, Kisselbach (DE)

(73) Assignee: TRIVIUM PACKAGING GROUP NETHERLANDS B.V., Deventer (NL)

( * ) Notice: Subject to any disclaimer, the term of this patent is extended or adjusted under 35 U.S.C. 154(b) by 413 days.

(21) Appl. No.: 16/485,767

(22) PCT Filed: Feb. 14, 2018

(86) PCT No.: PCT/IB2018/050906

§ 371 (c)(1),
(2) Date: Oct. 16, 2019

(87) PCT Pub. No.: WO2018/150338

PCT Pub. Date: Aug. 23, 2018

(65) Prior Publication Data

US 2020/0239205 A1 Jul. 30, 2020

(30) Foreign Application Priority Data

Feb. 14, 2017 (DE) ..... 10 2017 102 957.5
Jul. 11, 2017 (DE) ..... 10 2017 115 514.7

(51) Int. Cl.
*B65D 51/20* (2006.01)
*B65D 43/02* (2006.01)
(Continued)

(52) U.S. Cl.
CPC ..... *B65D 51/20* (2013.01); *B65D 43/0212* (2013.01); *B65D 51/246* (2013.01);
(Continued)

(58) Field of Classification Search
CPC .... B65D 1/20; B65D 43/0212; B65D 51/246; B65D 77/245; B65D 2251/0018;
(Continued)

(56) References Cited

U.S. PATENT DOCUMENTS 3,419,181 A * 12/1968 Stec ..... B65D 51/20 220/258.2
4,358,025 A * 11/1982 Urion ..... B65D 43/0212 215/DIG. 1

(Continued)

FOREIGN PATENT DOCUMENTS

CN 101506055 A 8/2009
FR 1077437 A 11/1954

(Continued)

OTHER PUBLICATIONS

International Search Report for related PCT/IB2018/050906 dated May 11, 2018.

(Continued)

*Primary Examiner* — J. Gregory Pickett
*Assistant Examiner* — Niki M Eloshway
(74) *Attorney, Agent, or Firm* — GREENBERG TRAURIG LLP

(57) ABSTRACT

Container having support for a membrane (30) which is sealed (by sealing means or adhesive bonding) onto the inner side (41) of the container wall (40) of the container, particularly while the container is being filled with contents or by virtue of a positive pressure being introduced. The intention is to relieve the sealing of the membrane of loading, wherein the action of force during the filling operation from beneath is advantageous or easily withstandable. For this purpose, the container is provided with the container wall (40), a container opening (2), a lid (10), the membrane (30) and a supporting structure (20). The lid (10)
(Continued)

closes the container opening (2). A portion of a membrane collar (31) of the membrane (30) is fastened on a portion of the inner side (41) of the container wall (40), a fastening region (33) therefore being formed. The supporting structure (20) has a supporting portion (21) and a carrying portion (22). The supporting portion (21) is assigned to the membrane (30) and the carrying portion (22) is assigned to the lid (10).

23 Claims, 7 Drawing Sheets

(51) Int. Cl.
*B65D 77/24* (2006.01)
*B65D 51/24* (2006.01)

(52) U.S. Cl.
CPC .... *B65D 77/245* (2013.01); *B65D 2251/0018* (2013.01); *B65D 2251/0093* (2013.01); *B65D 2543/00537* (2013.01); *B65D 2577/205* (2013.01)

(58) Field of Classification Search
CPC ..... B65D 2251/0093; B65D 2543/00537; B65D 2577/205
USPC ..... 220/258.2; 215/231
See application file for complete search history.

(56) References Cited

U.S. PATENT DOCUMENTS 4,993,577 A * 2/1991 Griffin ..... B65D 81/3453 220/258.5
5,096,078 A * 3/1992 McQueeny ..... B65D 51/26 206/522
5,586,676 A * 12/1996 Lynd ..... A47G 21/145 215/228
5,775,531 A 7/1998 Lowry
6,047,878 A * 4/2000 Lowry ..... B65D 3/262 220/258.2
6,068,154 A 5/2000 Grabher
6,398,051 B1 * 6/2002 Brozell ..... B65D 51/26 206/540
6,478,218 B1 * 11/2002 Boatwright ..... B65D 43/0212 229/125.05
8,328,036 B2 * 12/2012 Stevens ..... B65D 43/0208 220/258.1
2009/0065467 A1 * 3/2009 Heyn ..... B65D 51/20 215/317
2011/0139655 A1 * 6/2011 Cochran ..... B65D 79/02 206/459.1
2013/0047559 A1 * 2/2013 Minnette ..... B65D 43/0212 53/471
2018/0022505 A1 * 1/2018 Herlin ..... B65D 15/08 206/216
2019/0256230 A1 * 8/2019 Holka ..... B65B 1/02

FOREIGN PATENT DOCUMENTS

FR 2981333 A1 4/2013
GB 215988 A 5/1924
JP 10-211937 A 8/1998
WO 2013057392 A1 4/2013
WO 2016126191 A1 8/2016
WO 2016126193 A1 8/2016

OTHER PUBLICATIONS

Written Opinion for related PCT/IB2018/050385 dated May 11, 2018.

* cited by examiner

Schnitt A-A

CONTAINER HAVING A SUPPORTING STRUCTURE BETWEEN A CLOSURE MEMBRANE AND LID

BACKGROUND OF THE INVENTION

FIELD OF THE INVENTION

The invention relates to the technical field of packaging technology. In particular, the invention relates to the field of supporting a foil or membrane sealed to the inner side of a container, especially while filling the container with a liquid or solid material or introducing a positive pressure.

DESCRIPTION OF THE RELATED ART

When manufacturing a filled container comprising a membrane sealed or adhered to the inner side of the container, such as e.g. instant-coffee cans or baby-food cans, a packer, e.g. an instant-coffee manufacturer or baby-food manufacturer, typically uses prefabricated container blanks produced by a packaging manufacturer. The container blanks are often provided, by the packaging manufacturer, with the membrane and a press-in lid or a slip lid at the upper portions thereof (top side as encountered by a consumer in a supermarket). The membrane is often attached via a membrane collar that is circumferentially adhered to the inner side of the container. The packer fills the container blanks from beneath and closes the bottom side of the container, for example, by flanging. Thus, a filled container can be produced.

The filling operation from beneath is problematic with respect to the tightness of a membrane sealed to the inner side of a container. When a solid or liquid material is filled into the container from beneath by the packer, the filling material hits the membrane. In the process, a not minor force acts on the membrane surface (plane perpendicular to the container axis) which is transferred to the circumferential and axially extending adhesive region between the membrane collar and the container inner side, causing peeling forces to act on the adhesions which are particularly unfavorable for adhesions. In addition, a gassing (e.g. using a protective gas) of the space in which the filling material is stored is often performed. Typically, this is performed during the filling operation. When the lower opening of the container through which the filling material and the gas have been introduced is closed, a positive pressure with respect to the space on the other side of the membrane can prevail in the space in which the filling material is stored in the closed state. Accordingly, a further force can act on the membrane which is, in turn, transferred to the adhesive region between the membrane collar and the container inner side and which can be poorly accommodated by the adhesion. Furthermore, a positive pressure can be caused in the space in which the filling material is stored in the closed state of the container when the filling operation is performed without using positive pressure if the container is stored, after the filling operation by the filler, in a place having a lower air pressure than the place of filling and the lower pressure acts on the side of the membrane not facing the filling material. Such differences in air pressure arise, for example, from different heights of places and in the case of a space above the membrane (not the side of the membrane facing the filling material) which is at least not completely closed in a gas-tight manner. All this may compromise or even completely destroy the integrity of the membrane adhesion.

It is the object of the invention to provide a container comprising a membrane which is sealed or adhered to the container inner side, wherein the action of a force during a filling operation from beneath is favorable for or easy to resist by the membrane adhesion.

SUMMARY OF THE INVENTION

The object is achieved by a container described here that can be used as described herein and can be employed in a method for manufacturing a filled container as described herein. Embodiments describe the filling of the container comprising the support structure for protection of the tie strap of the foil lid.

The container comprises a container wall, a container opening, a lid, a membrane (or foil), and a support structure. The lid closes the container opening. The membrane comprises a membrane collar and a portion of the membrane collar is attached to the inner side of the container wall. An attachment region is formed in the region in which the portion of the membrane collar is attached to the inner side of the container wall. The support structure comprises a support portion and a bearing portion. The support portion of the support structure is associated with the membrane and the bearing portion of the support structure is associated with the lid.

A force acting on the membrane (especially on the membrane bottom) in the direction of the lid (and of the support structure) can be diverted by the support structure such that a force resulting therefrom, the shearing component of which is greater than its peeling component, acts in the attachment region.

It is also possible to divert the force acting on the membrane (membrane bottom) in the direction of the lid or of the support structure by the support structure such that the force acting in the attachment region as a result of this has a shearing component that is greater than the shearing component of a force occurring in the attachment region when the support structure is not used (under otherwise equal conditions). In other words, by using the support structure, the shearing component of the force acting in the attachment region can be increased with respect to the force acting when the support structure is not used (under otherwise equal conditions). Thus, the strength of the attachment region is increased.

The shearing component of a force acting on the attachment region acts in parallel with the attachment region and the peeling component of a force acting on the attachment region acts perpendicular to the attachment region.

The attachment of the membrane (via the membrane collar) at the inner side of the container wall can be formed by adhesive bonding or sealing. For example, an adhesive can be applied to the side of membrane to be attached to the container wall. The adhesive may have adhesive properties without any further treatment. The adhesive can also be meltable, for example, a polymer (polyethylene). One of the adhesives can also be applied to the container wall, especially in the region in which the membrane collar of the membrane is to be attached. One of the adhesives can be applied to both, the membrane collar and the container wall.

The attachment of the membrane via the membrane collar is preferably performed such that two spaces are formed in the container which are separated from each other in a fluid-tight manner. In spaces separated from each other in a fluid-tight manner, the material exchange between these spaces is considerably less (by a multiple) than the material exchange between two spaces which are separated from each other, but not separated from each other in a fluid-tight manner. A person skilled in the art is aware that a completely fluid-tight separation between two spaces cannot be (practically) realized and that a slight, often negligible material exchange occurs even in spaces separated in a fluid-tight manner. A slight material exchange takes place already by diffusive processes.

The membrane or foil preferably has a thickness of less than 1 mm, especially less than 250 μm. It can be made of or comprise metal (especially aluminum), plastic material, a coated plastic material (especially coated with metal, in particular aluminum), paper or cardboard, and a composite material of two or more of the materials. In particular, the membrane comprises a plasma-coated plastic material, wherein the coating comprises a metal.

The container can be a metallic container. Preferably, the container is a metallic can. The container can be cylindrical.

The inner volume of the container in the closed state can be less than 25 l, preferably less than 10 l, particularly preferably less than 5 l, even more preferably 3 l. The container can have a height of less than 500 mm, preferably less than 300 mm, particularly preferably less than 150 mm.

The container can have a circular (wall) cross-section. The outer diameter of the container or of the container wall can be less than 300 mm, preferably less than 200 mm, particularly preferably less than 150 mm.

The lid can be a press-in lid, a slip lid or a tear-open lid.

Within the scope of the invention, a "container" does not have to be an object, the openings of which are all completely closed. Within the scope of the invention, containers typically comprise two openings, preferably on opposite sides. One of the openings is closed by the lid. The other opening is typically open. A filling material can be introduced into the opening that is open and the opening can be closed subsequently so that the filling material is protected from "falling out". The filling material is then stored in a space in the interior of the container which is defined by a membrane, the container wall and the closure of the opening which was open before introducing the filling material. Such a closure can be connected to the container wall by flanging.

The attachment region which is formed by attaching a portion of the membrane collar of the membrane to the container wall can have an extension in the axial direction (z-direction) that is greater by a multiple than in the radial direction (r-direction).

The attachment region is typically the region in which the membrane collar is attached to the container wall, for example, by adhesive bonding. The attachment region provides for a secure attachment of the membrane (via the membrane collar) and provides for a secure separation of the space above the membrane from the space below the membrane.

Preferably, the support portion of the support structure contacts the membrane. Such a contacting can also be partially formed so that the support portion partially contacts the membrane. The contacting is performed without application of a force to the membrane so that no additional force (caused or transferred by the support portion) has to be accommodated in the attachment region.

The support portion can also not contact the membrane. Typically, the non-contacting is performed in the initial state of the membrane. The initial state of the membrane is given when the pressure in the space above the membrane (in the space where the support structure is arranged) is somewhat greater than the pressure in the space below the membrane, wherein the membrane is not elastically or plastically deformed (for example, stretching). The somewhat greater pressure is, for example, within a range of 100 mbar to 200 mbar above ambient pressure.

Preferably, the support portion contacts the membrane and a force is exerted on the membrane by the support portion. The force can be caused by the support portion, or a force can be transferred or transmitted by the support portion. The force thus acting on the membrane is accommodated in the attachment region, for example, by an adhesion.

A gap can be provided between the support portion and the membrane collar. When a gap is formed between the support portion and the membrane collar (the nearest surface of the membrane collar), the support portion does not abut, at least in sections, the membrane collar. Preferably, the gap is formed over the entire circumference.

The gap is preferably less than 20 mm, particularly preferably less than 10 mm, even more preferably less than 5 mm, especially less than 2 mm in the radial direction (r-direction) perpendicular to the container wall.

The support portion can be annular in shape. The support portion can have, at least in sections, a circular cross-section, a rectangular cross-section, especially a rectangular cross-section with rounded corners, or a square cross-section, especially with rounded corners in the circumferential direction.

The support portion can be cohesively connected to the bearing portion. Preferably, the support structure is integrally formed of the support portion and the bearing portion.

The bearing portion of the support structure can be connected to the lid. The bearing portion is connected to the lid such that the weight of the bearing portion or of the support structure can be borne entirely by the connection of the lid.

Preferably, the bearing portion comprises a bearing element that is bar-shaped. More preferably, the bearing portion comprises three bearing elements that each are bar-shaped. The bearing portion or bearing portions especially has/have, at least in sections, a circular cross-section or a rectangular cross-section.

The lid can comprise a snap element, wherein an upper portion of the bearing element is snapped into the snap element. The lid preferably comprises three snap elements, wherein one upper portion each of three bearing elements is snapped into one snap element.

In this sense, a snap connection is a connection between two elements, wherein at least one of the elements is deformed during the joining (connecting) process of the elements until a final position of the elements relative to each other is reached and the at least one deformed element returns to its initial shape by elastic recovery. After recovery, the elements are at least positively connected in the final position.

Typically, the snap connection is releasable by an analog elastic deformation of at least one of the elements.

The membrane can comprise a membrane bottom having a top side and the support portion can comprise a support-portion bottom side. An axial height (or length) $H_1$ between an axial reference height and the support-portion bottom side is preferably less than or equal to an axial height (or length) $H_2$ between the (same) axial reference height and the top side of the membrane bottom.

The membrane bottom is the portion of the membrane which is arranged substantially flat and perpendicular to the container longitudinal axis, i.e. the portion extending flat between the container wall and due to which there are separate spaces above and below the membrane.

The top side of the membrane bottom is the side (or surface) of the membrane facing the support structure.

The axial height between the top side of the membrane bottom and the reference height is determined in the initial state of the membrane, wherein the above explanations refer to the initial state of the membrane.

The height $H_1$ between an axial reference height and the support-portion bottom side is preferably less than the height $H_2$ between the axial reference height and the top side of the membrane bottom by less than 5 mm, more preferably the height $H_1$ is less than the height $H_2$ by less than 3 mm, even more preferably the height $H_1$ is less than the height $H_2$ by less than 1 mm, and most preferably the height $H_1$ is less than the height $H_2$ by less than 0.5 mm.

In principle, any height or any point can be used as a reference height or reference point, however, the use of the axial height of the lid or the axial height of a container edge of the container is preferred as a reference height.

A force $F_{fill}$ acting on the membrane (or on the membrane bottom) that can be caused, for example, by a filling operation or a positive pressure, as described at the beginning, is preferably, at least in part, accommodated by the support portion.

By accommodating a part of the force acting on the membrane, the strain in the attachment region is reduced. For example, the force can be transferred by the support portion to the bearing portion and from there to the lid or the connection thereof to the container wall.

A force $F_{fill}$ acting on the membrane (or the membrane bottom) which can, in turn, be caused in the course of the filling operation or by a positive pressure can be partially diverted by the support portion such that a force $F_{res}$ having a shearing component that is greater than a peeling component acts in the attachment region between the membrane collar and the portion of the inner side of the container. A part of the force $F_{fill}$ acting on the membrane is accommodated by the connection of the lid to the container wall, as described above.

By diverting the force, a force acts in the attachment region which can be accommodated, for example, by an adhesion in a significantly improved manner as compared to the force that would act if the force $F_{fill}$ was not diverted. Without diversion, the force acting in the attachment region would be characterized by a peeling component, i.e. the peeling component would be greater than the shearing component. Based on the direction of a force relative to the attachment region, the components thereof can be divided into the components (shearing component, peeling component) described at the beginning.

Preferably, an object can be deposited between the lid and the membrane. Such an object can be, for example, a spoon or chopsticks.

The lid and the support structure can be formed integrally. In this case, the lid and the support structure are cohesively connected, wherein the lid and the support structure can be manufactured as a unit (in one piece), or the lid and the support structure can be manufactured as separate parts and the separate parts can be cohesively connected to each other (e.g. by welding).

The support structure can comprise a predetermined breaking point. Preferably, the predetermined breaking point is arranged at a bearing element of the support structure. If the support structure comprises a plurality of bearing elements, a plurality of predetermined breaking points can be arranged at the support structure. Preferably, one predetermined breaking point is provided per bearing element.

By providing a predetermined breaking point, especially in conjunction with an integral design of the lid and the support structure, the support structure can be released from the lid when a consumer removes the lid from the container for the first time. Then, the consumer can dispose of the support structure, since it is required primarily during the packaging process and during storage (prior to removing the membrane).

Preferably, a distance between the predetermined breaking point and the lid is short. Especially less than 20 mm, less than 10 mm or less than 5 mm.

A filled container can be manufactured by providing one of the containers described herein, wherein the container comprises an opening provided opposite to the lid or at the end of the container that is opposite to the end closed by the lid (also referred to as filling opening). A solid or liquid filling material can be introduced into the opening provided opposite to the lid or at the end of the container that is opposite to the lid. In addition, a gas (e.g. nitrogen) can be introduced into the space into which the filling material has been introduced or is to be introduced. Then, the opening though which the filling has been performed can be closed.

After the filling operation, the opening can be closed, for example, by flanging using a piece of sheet metal.

As a result of the closing, the filling material is located in a space that is defined by the membrane, the container wall and the closure closing the opening through which the filling material has been filled.

If a gas, e.g., nitrogen, is additionally introduced during the introduction of a filling material (solid or liquid) into the container, a positive pressure (with respect to the environment) can prevail in the space into which the filling material has been introduced after closing the filling opening. The positive pressure is preferably less than 500 mbar, more preferably less than 350 mbar, and especially at most 200 mbar with respect to ambient pressure in each case.

The containers described herein, the containers being containers closed by a foil membrane on one side, can be filled using the method described below. For this purpose, a described container is provided, wherein the container comprises an opening provided opposite to the lid or the opening is provided at the end of the container that is opposite to the end closed by the lid (filling opening). The filling material is filled into the opening provided opposite to the lid (filling opening), wherein the filling material falls on the membrane (or the membrane bottom) and the support portion of the support structure transfers or diverts the emerging force to the attachment region, wherein the force mainly acts as a shearing force in the attachment region.

The described containers can be used for preserving or storing a foodstuff. In particular, the foodstuff is, at least in part, powdery.

BRIEF DESCRIPTION OF THE DRAWINGS

The embodiments of the invention are illustrated by means of examples and are not disclosed in a way that transfers or incorporates limitations from the Figures into the patent claims. The examples are to be understood as examples even if the terms "for example", 'especially' or "e.g." are not used in all places. The description of an embodiment or a design is not be understood such that there is no other one or that other possibilities are excluded if only one example is presented. These specifications apply to the entire description that follows.

DETEAILED DESCRIPTION OF THE PREFERRED EMBODIMENTS

Figure 1:
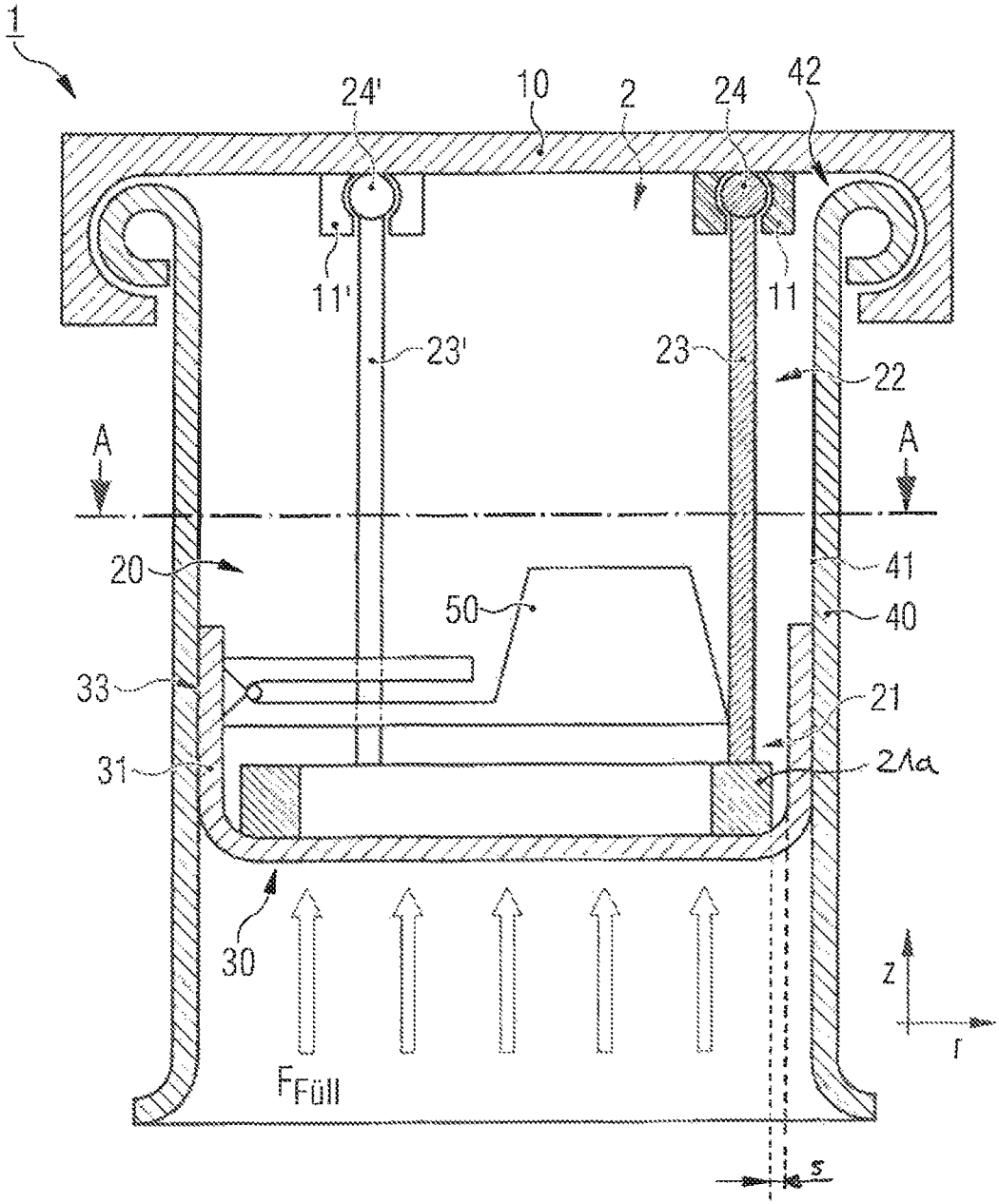
FIG. 1 shows a side view of a container 1 in axial cross-section.

FIG. 1 shows a container 1 comprising a lid 10, a support structure 20, a membrane 30 and a container wall 40. The container 1 comprises a filling opening 60 at its lower end (in the negative z-direction). The filling opening 60 is located at the end on the side of the container 1 that is opposite to the lid 10. For example, a food manufacturer or food packer can fill a foodstuff into the open space formed by the membrane 30 and the container wall 40 through the filling opening 60.

During the filling operation of the filling material, the container 1 is typically rotated by 180° with respect to the representation in FIG. 1 so that the side of the container 1 terminating in the filling opening 60 is at the top and the side of the container 1 terminating in the lid 10 is at the bottom. Thus, a food manufacturer or food packer can let the filling material drop or trickle or flow in (fill) the space that is accessible through the filling opening 60. During the filling operation, a force $F_{fill}$ acts on the membrane 30 due to the weight of the filling material and the filling material hitting the membrane 30 (the filling material can be filled into the container from a considerable height), wherein the force $F_{fill}$ mainly acts on the membrane bottom 32 of the membrane 30.

The membrane 30 comprises a membrane collar 31 that is connected to an inner side 41 of the container wall 40. Typically, the membrane collar 31 has an axial extension or height (z-direction) of less than 20 mm, preferably less than 15 mm.

Preferably, the connection of the membrane collar 31 to the inner side 41 of the container wall is completely circumferential so that two spaces are provided above and below the membrane 30 or the membrane bottom 31 that are separated from each other in a fluid-tight manner, wherein the spaces can be open.

The (circumferential and axially extending) region in which the membrane collar 31 is connected to the inner side 41 of the container wall 40 forms an attachment region 33.

Typically, the attachment of the membrane is formed by adhesive bonding or sealing, as also described above. The attachment region 33 does not have to occupy the entire height of the axial extension of the membrane collar 31, rather the axial height or extension of the attachment region 33 is often less than the axial extension of the membrane collar 31. The axial extension of the attachment region 33 can be less than 15 mm, preferably less than 10 mm, particularly preferably less than 8 mm.

As discussed in detail above, the force $F_{fill}$ acting on the membrane 30 due to the filling operation of the filling material would act in the attachment region 33, for example, as a force that is unfavorable to resist by an adhesion and has a large peeling component. By arranging the support structure 20 in the container 1, the force $F_{fill}$ acting on the membrane 30 during the filling operation is, at least in part, diverted such that a force acts in the attachment region, the peeling component of which is reduced with respect to a peeling component of the force that would act in the attachment region of a container 1 without a support structure (under otherwise equal conditions). In addition, the force $F_{fill}$ acting on the membrane 30 is, in part, transferred by the support structure 20.

The support structure 20 comprises a support portion 21 associated with the membrane 30 and a bearing portion 22 associated with the lid 10. The force $F_{fill}$ acting on the membrane 30 is diverted and/or transferred by the support portion 21 since the membrane bottom 32 contacts the support portion at least during the filling operation of the filling material and the support structure 20 is connected to the lid 10 via the bearing portion 22.

In the embodiment of FIG. 1, the support portion 21 is composed of an outer support ring 21*a*, wherein the support portion 21 can comprise further elements in other embodiments. The typically flexible membrane 30 can be deformed towards the support portion 21 of the support structure 20 by the filling operation.

In FIG. 1, the lid 10 is designed as a slip lid and is fixed to a rolled edge 42, wherein the rolled edge 42 is formed at the upper end (in the positive z-direction) of the container wall 40. The bearing portion 22 of the support structure 20 can transmit a force transferred by the support portion 21 to the lid 10, wherein the transmitted force can be accommodated by the attachment of the lid 10 to the rolled edge 42. Furthermore, the diversion of force by the support portion 21 is enabled by associating the bearing portion 22 to the lid 10 and fixing the lid 10 to the rolled edge 42.

Figure 3:
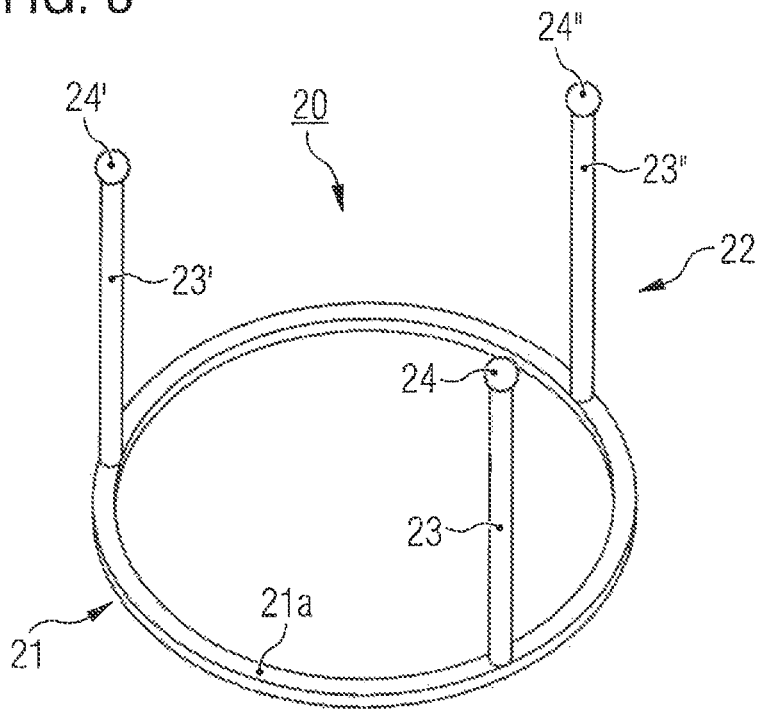
FIG. 3 shows a support structure 20 in a perspective view.

In FIG. 1, the bearing portion 22 comprises three bearing elements 23, 23', 23", wherein only two bearing elements 23, 23' are visible owing to the sectional view. A perspective view of the support structure 20 comprising the bearing elements 23, 23', 23" is shown in FIG. 3 which is described in detail further below.

The bearing elements 23, 23', 23" are bar-shaped and include a spherical portion 24, 24', 24" at the upper end (in the positive z-direction) in each case, wherein again only two spherical portions 24, 24' are visible in FIG. 1 owing to the sectional view.

Snap elements 11, 11', 11" are arranged at the bottom side of the lid 10 (in the negative z-direction) of which only two snap elements 11, 11' are visible in FIG. 1. The snap elements 11, 11', 11" are formed such that at least the spherical portions 24, 24', 24" can snap into them, thereby providing a (releasable) connection of the support structure 20 to the lid 10.

The lid 10 closes a container opening 2 of the container 1 that is located (at the end) on the side of the container 1 opposite to the filling opening 60. Typically, the container opening 2 serves the purpose of enabling a consumer to reach into the container 1 when the container 1 is filled with a filling material and the filling opening 60 is closed (and the lid 10 is removed).

After opening the filled container 1 by removing the lid 10, wherein the filling opening 60 is closed, a consumer can withdraw the support structure 20 from the space above the membrane 30 (where the support structure 20 is arranged).

Typically, the support structure 20 is a disposable article which is disposed of by the consumer after withdrawal. This is also because the function of the support structure 20 primarily comes into effect during the filling operation of the filling material, i.e. before a consumer can purchase the filled container.

A spoon 50 is disposed in the space which has become accessible by opening or removing the lid 10 (in which the support structure is or was arranged). The consumer can reach into the container opening 2 to arrive at the spoon 50.

The consumer can remove the membrane 30 or a portion of the membrane 30, for example, by a pull tab or a tear tab provided at the membrane 30 so that the filling material is accessible to the consumer. The filling material can be removed by using the spoon 50.

Generally, cutlery can be disposed in the space above the membrane 30 (in the positive z-direction) instead of the spoon 50. Other objects can also be disposed there, such as e.g. an advertising medium or a sachet (bag) including spices.

The container opening 2 is preferably re-closable by the lid 10.

The lid 10 can be a press-in lid.

In FIG. 1, a gap s is provided between the support portion 21 of the support structure 20 and the membrane collar 31 of the membrane 30. The length of the gap s in the radial direction (r-direction) is preferably small, as described above.

The membrane 30 can be attached to the inner side 41 of the container wall 40 in various axial height positions. The distance of the membrane 30, which is determined by the axial height of the membrane bottom 32, to the upper end of the container 1 (in the positive z-direction) is preferably less than 70% of the total container height, particularly preferably less than 55% of the total container height, even more preferably less than 40% of the total container height, most preferably less than 30% of the total container height.

Two or more than two membranes 30 can be arranged in the various height positions described above.

Figure 2:
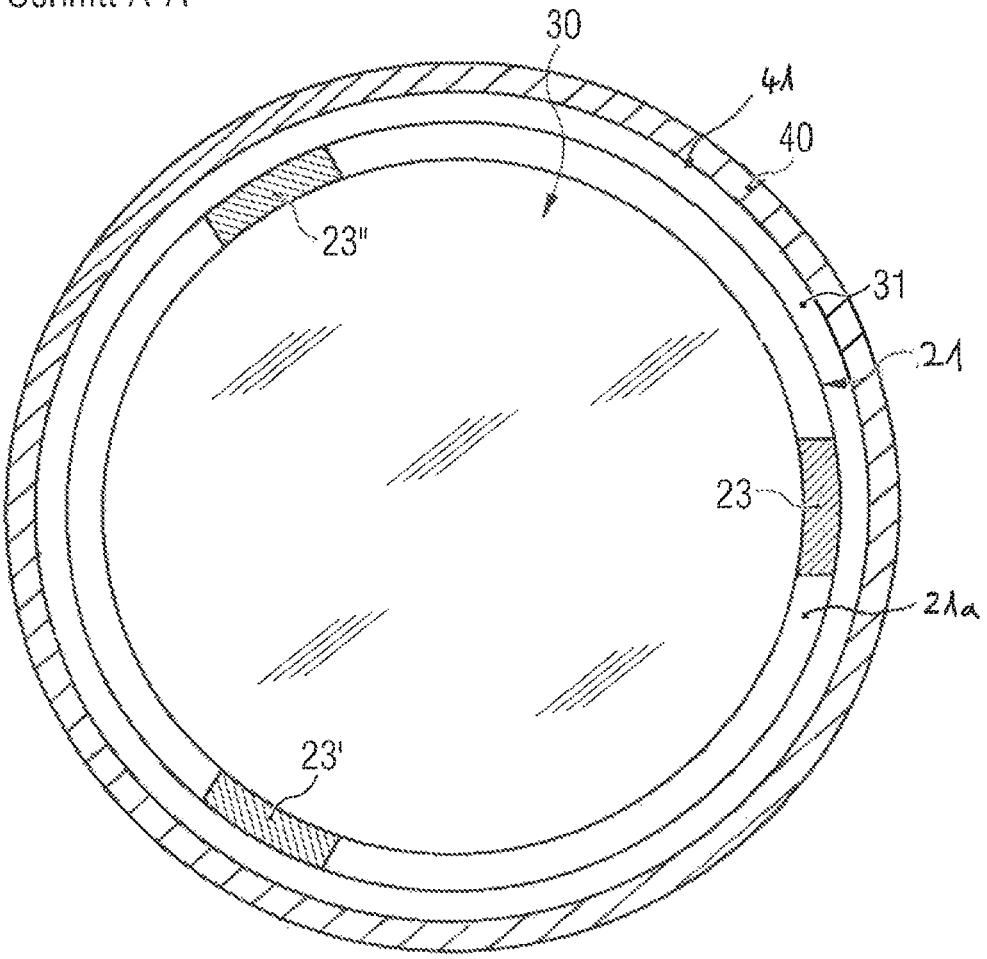
FIG. 2 schematically shows the section A-A of FIG. 1, without showing the spoon 50 of FIG. 1.

FIG. 2 schematically shows the section A-A of FIG. 1, in which the proportions of the elements shown in FIG. 2 do not always correspond to those of FIG. 1 and the spoon 50 of FIG. 1 is not illustrated. Moreover, the gap s of FIG. 1 is 0 (zero) so that the support portion 21 (outer support ring 21*a*) of the support structure 20 radially abuts the membrane collar 31 of the membrane 30.

The membrane collar 31 is connected to the inner side 41 of the container wall 40 in a completely circumferential (and fluid-tight) manner. The outer support ring 21*a* of the support structure 20 is annular in shape.

Three bearing elements 23, 23', 23" are cohesively connected to the outer support ring 21*a*. As shown in FIG. 1 and described with respect to the third bearing element 23", the bearing elements 23, 23', 23", as components of the bearing portion 22, are connected to the lid 10 such that a force acting on the outer support ring 21*a* (support portion 21) via the membrane 30 can be partially accommodated by the connection of the lid 10 to the container wall 40 or, as in FIG. 1, to the rolled edge 42.

Moreover, the connection of the lid 10 to the container wall 40, as is the case when using a press-in lid, or to the rolled edge 42 provides the counterforce or retention force that is required to enable a diversion of the force acting on the membrane 30 (or on the membrane bottom 32) to the attachment region 33 as a force that can be accommodated more favorably and has an increased shearing component (reduced peeling component).

The bearing elements 23, 23', 23" are arranged at the (circular) annular outer support ring 21*a* in a circumferentially equidistant manner.

The outer support ring 21*a* can also have an oval shape (with or without an axis of symmetry) or a polygon shape. Preferably, the shape of the outer support ring 21*a* corresponds to the shape of the cross-section (perpendicular to the container longitudinal axis) of the container wall 41 in the portion of the container wall 41 to which to the membrane 30 is attached.

More than three bearing elements can be arranged at the support portion 21, for example, at the outer support ring 21*a*. In particular, four, five or more than five bearing elements can be arranged at the support portion 21. A same number of snap elements corresponding to the number of bearing elements can be arranged at the lid 10. The more than three bearing elements are preferably distributed in a circumferentially equidistant manner.

Similarly, one bearing element can be arranged at the support portion 21, wherein the bearing element can be formed completely circumferentially (in the shape of a hollow cylinder). The upper portion of the completely circumferential support portion 21 can be annular in shape. A completely circumferential snap element can be arranged at the lid 10.

Two bearing elements are also possible.

A support structure 20, as shown in FIG. 1 and FIG. 2, is shown in perspective view in FIG. 3, wherein the proportions of the elements shown in FIG. 3 do not always correspond to the proportions of the elements of the support structure of FIG. 1 and FIG. 2.

The support structure 20 in FIG. 3 comprises an outer support ring 21*a* as a support portion 20 and three bearing elements 23, 23', 23" which are cohesively connected to the outer support ring 21*a*. The outer support ring 21*a* has a rectangular cross-section.

The bearing elements 23, 23' 23" are bar-shaped and have a circular cross-section. The bearing elements 23, 23', 23" comprise a spherical end portion (upper portion of the bearing elements 23, 23', 23").

Figure 3A:
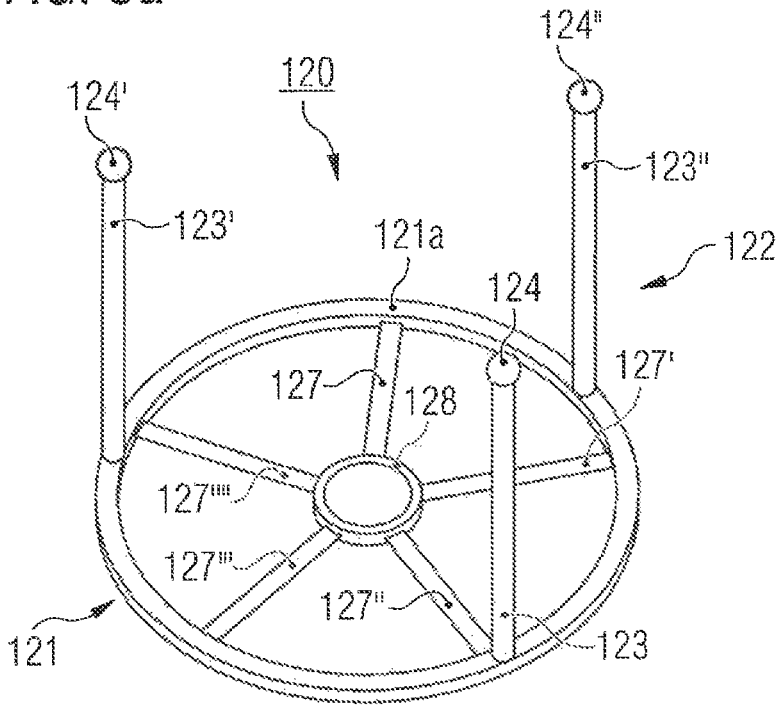
FIG. 3*a* shows a support structure 120 in a perspective view.

FIG. 3*a* shows another embodiment of a support structure 120 comprising a support portion 121 and a bearing portion 122. The support portion 121 comprises an outer support ring 121*a*, an inner support ring 128 and a plurality of support bars 127, 127', 127", 127''', 127'''' that are distributed in a circumferentially equidistant manner. The inner support ring 128 is connected to the outer support ring 121*a* by the support bars 127, 127', 127", 127''', 127''''.

Due to this design of the support portion 121 of the support structure 120, a membrane 30 can be supported flat. Thus, as described above, forces acting on the membrane 30 (membrane bottom 32) can be transferred to the connection of the lid 10 to the container wall 40 or to the rolled edge 42 to a greater extent than is the case with the support structure 20 of FIG. 3.

This embodiment further comprises bearing elements 123, 123', 123" having spherical upper portions 124, 124', 124" which are analogous to the bearing elements 23, 23', 23" having spherical upper portions 24, 24', 24" of the embodiment of FIG. 3.

Figure 3B:
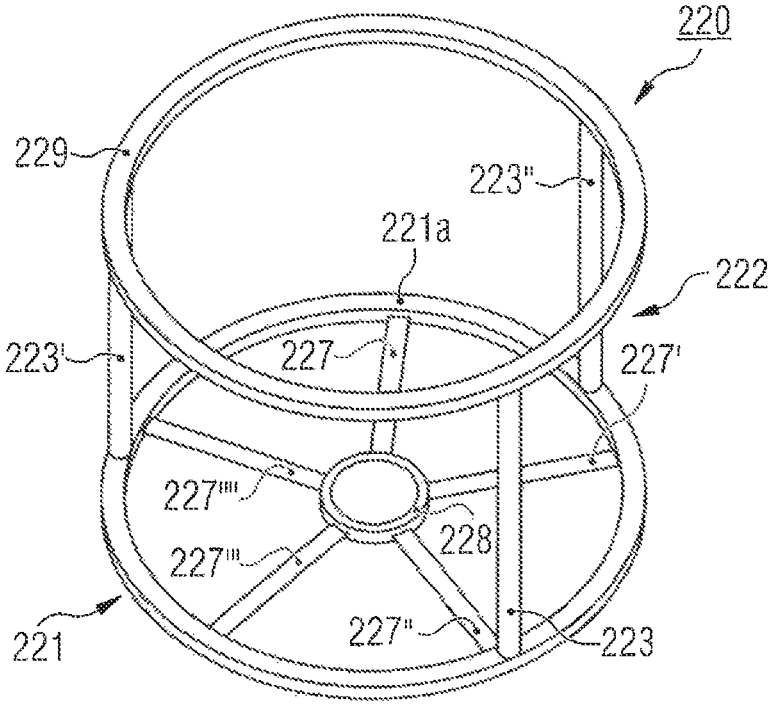
FIG. 3*b* shows a support structure 220 in a perspective view.

FIG. 3*b* shows an embodiment of a support structure 220 comprising a support portion 221 and a bearing portion 222. The support portion 221 comprises an outer support ring 221*a*, an inner support ring 228 and a plurality of support bars, 227, 227', 227", 227''', 227''''. The support portion 221 of this embodiment is analogous to the support portion 121 in FIG. 3*a*.

The bearing portion 222 comprises three bearing elements 223, 223', 223" which are connected to the outer support ring 221*a* and a bearing ring 229. The bearing ring 229 is (circular) annular in shape and has a rectangular cross-section. The snap element or snap elements of the lid 10 is/are adapted accordingly so that the bearing ring 229 can snap into one or a plurality of snap elements of the lid 10. The bearing ring 229 can also have a circular cross-section.

Preferably, the bearing ring 229 has the same diameter as the outer support ring 221*a*. The bearing ring 229 and the outer support ring each span a plane, wherein the planes can be parallel to each other.

Figure 3C:
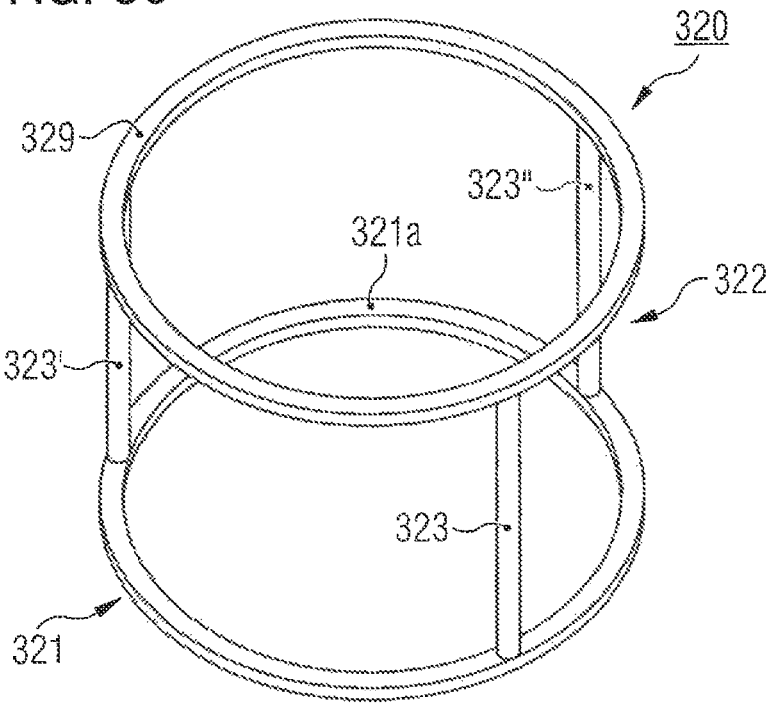
FIG. 3*c* shows a support structure 320 in a perspective view.

FIG. 3*c* shows a further embodiment of a support structure 320 comprising a support portion 321 and a bearing portion 322. The support portion 321 is composed of an outer support ring 321*a*. The bearing portion 322 comprises three bearing elements 323, 323', 323" which are connected to the outer support ring 321*a* and a bearing ring 329. The bearing portion 322 is analogous to the bearing portion 222 in FIG. 3*c*.

The bearing elements 23, 23', 23"; 123, 123', 123"; 223, 223', 223", 323, 323', 323" have a length (extension along the container longitudinal axis) of preferably at most 100 mm, more preferably at most 80 mm, even more preferably at most 50 mm.

Figure 4:
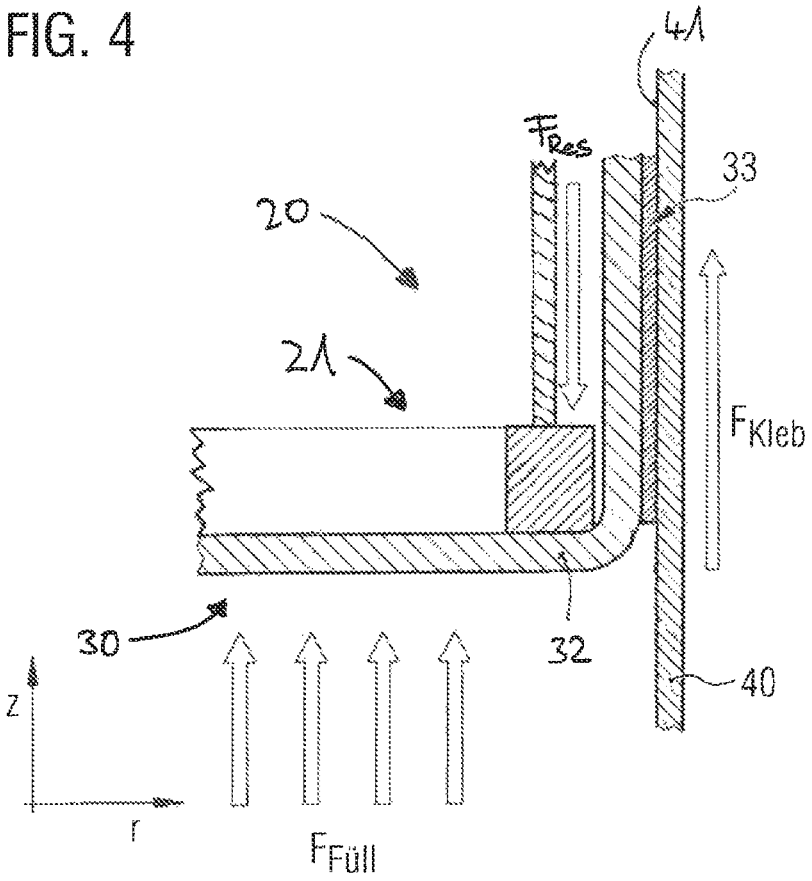
FIG. 4 shows a detailed schematic view of the attachment region 33 which is formed by attaching the membrane collar 31 of the membrane 30 to the inner side 41 of the container wall 40.

FIG. 4 shows, by means of a detailed view of a cutout that shows a connection of the membrane 30 to the container 40, how a diversion of force can be performed by a support structure 20.

When the filling material is filled into the filling opening 60 of a container 1 (cf. FIG. 1), the filling material can hit the membrane bottom 32, causing a force $F_{fill}$ to act on the membrane 30. The membrane 30 is connected to the inner side 41 of the container wall 40 via a membrane collar 31. In the embodiment of FIG. 4, the connection is an adhesion, wherein the attachment region 33 comprises an adhesive layer.

A support structure 20 is arranged on the side of the membrane 30 that is opposite to the (later) introduced filling material, wherein the support portion 21 abuts the membrane bottom 32. Due to the support structure 20, the force $F_{fill}$ acting on the membrane 30 (membrane bottom 32) can be diverted to the attachment region 33 such that a resulting force $F_{res}$ acts there. The resulting force $F_{res}$ in the attachment region 33 must be capable of being accommodated such that damage to the connection between the membrane collar 31 and the inner side 41 of the container 40 does not compromise the tightness of the connection. In the case of the adhesion in FIG. 4, the resulting Force $F_{res}$ is compensated by a force $F_{adh}$ provided by the adhesion and can be accommodated accordingly.

As a result of the diversion, the shearing component (action of force in parallel with the attachment region 33) of the resulting force $F_{res}$ is greater than the shearing component of the force that would act in the attachment region if the support structure 20 was not used. For the sake of clear representation, the force $F_{res}$ illustrated in FIG. 4 only has a shearing component, whereas, in reality, also a peeling component can occur which would lead to the resulting force $F_{res}$ not being in parallel with the attachment region.

Even if the diversion of force does not result in a force that only has a shearing component, the increase in the shearing component leads to the requirements to quality of the adhesion being reduced or an improved tightness being able to be ensured while maintaining the same quality of the adhesion.

Figure 5:
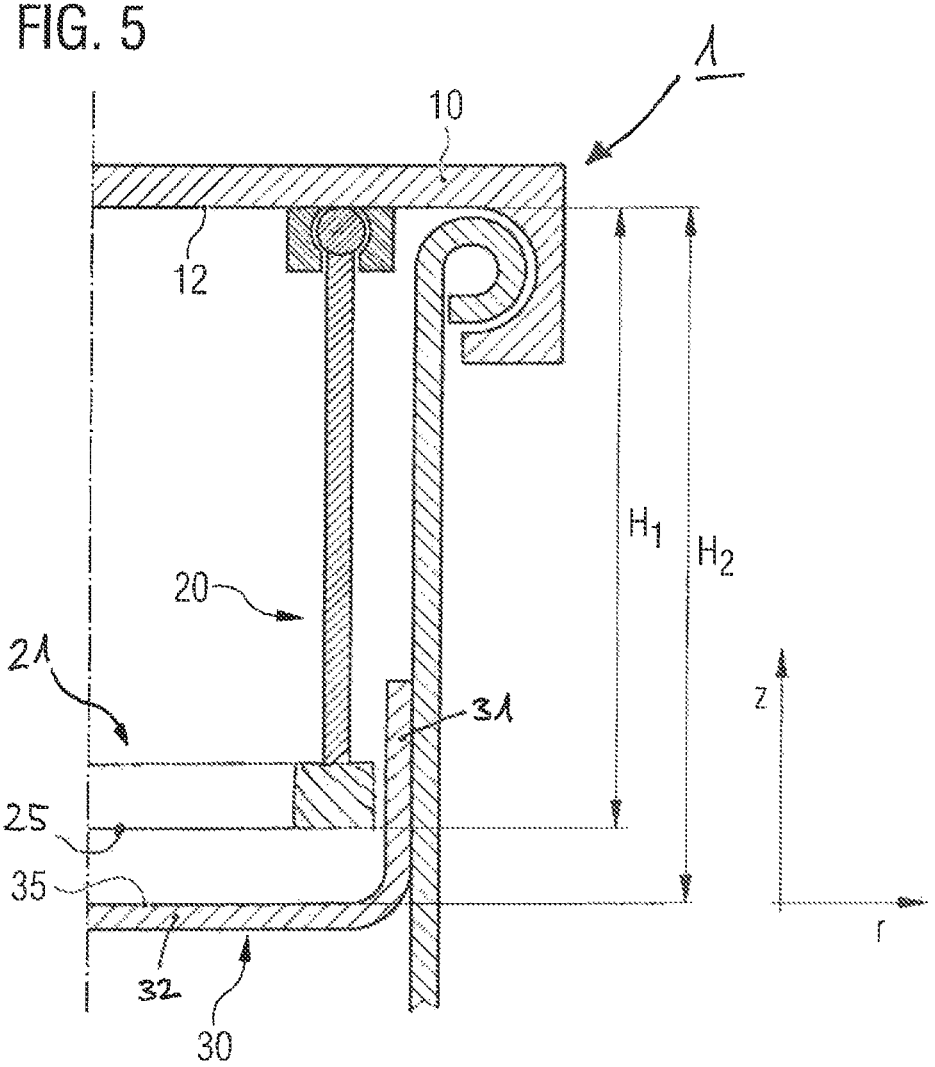
FIG. 5 shows a detailed sectional view of an upper region of the container 1.

A container 1 comprising a lid 10, a support structure 20 and a membrane 30 is shown in FIG. 5. The membrane 30 is in the initial state described above. The membrane 30 comprises a membrane bottom 32 having a membrane-bottom top side 35 and a membrane collar 31. The lid 10 comprises a lid bottom side 12. The support structure 20 comprises a support portion 21 having a support-portion bottom side 25.

An axial (in the z-direction) distance $H_1$ (also referred to as length or height) is formed between the lid bottom side 12, as a reference point, and the support-portion bottom side 25. An axial (in the z-direction) distance $H_2$ (also referred to as length or height) is formed between the lid bottom side 12, as a reference point, and the membrane-bottom top side 35. In FIG. 5, the length $H_1$ is less than the length $H_2$.

Thus, no pressure is exerted on the membrane bottom 32 of the membrane 30 when the membrane 30 is in its initial state. When a force is exerted on membrane bottom 32 in the positive z-direction, the membrane bottom 32 can be deformed towards the support-portion bottom side 25 so that the force acting on the membrane bottom 32 can be diverted and/or transferred by the support structure 20.

In general, the filling material which is to be introduced or is introduced into the container 1 into the space below the membrane 30 can be a foodstuff, especially a powdery foodstuff. The space below the membrane 30 is the space that is defined, at least on one side, by the membrane 30, but does not comprise the support structure 20.

The protective gas preferably comprises nitrogen, in particular, the protective gas comprises nitrogen having a concentration of more than 80 vol % (proportionate to the composition of the entire protective gas).

Figure 6:
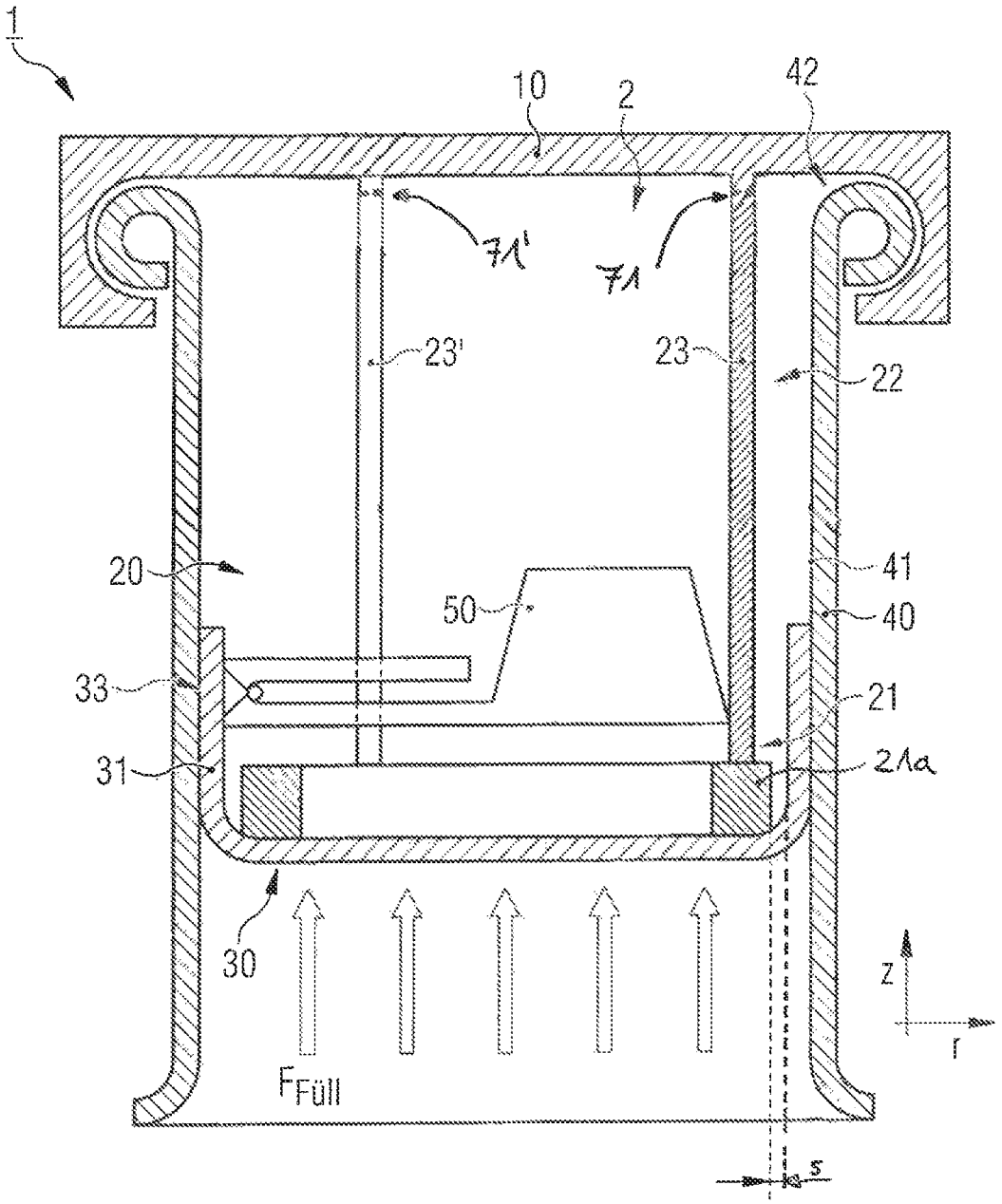
FIG. 6 shows a container 1 in an axial sectional view.

In FIG. 6, a container 1 is shown that is similar to the container of FIG. 1, wherein the support structure 20 is formed integrally or in one-piece with the lid 10. The lid 10 is cohesively connected to the support structure 20, especially to the bearing elements 23, 23', 23" (bearing element 23" is not shown owing to the sectional view).

In this embodiment, one predetermined breaking point 71, 71', 71" each is provided at one of the bearing elements 23, 23', 23", wherein the predetermined breaking point 71" provided at the bearing element 23" is not visible owing to the sectional view. In the representation of FIG. 6, the predetermined breaking points 71, 71', 71" are designed as slittings in the bearing elements 23, 23', 23", wherein the slitting causes a material weakening to mechanical stress, as compared to non-slitted bearing elements 23, 23', 23".

A separation of the support structure 20 from the lid 10 is to be expected at the positions of the predetermined breaking points of the bearing elements 23, 23', 23", when a consumer opens the lid 10 and removes the lid 10 from the container 1 during opening using a sufficiently large force and in a way deviating from an exclusively axial removal so that the support portion 21 abuts the inner side 41 of the container wall 40.

Predetermined breaking points can also be designed as cross-sectional taperings in bearing elements or by using a portion in the bearing elements made of a material that is less mechanically resistant than the material of the residual portions of bearing elements.

Besides, the container of the embodiment of FIG. 6 corresponds to the embodiment of FIG. 1 and the disclosure of the embodiment of the Figure also applies to the embodiment of FIG. 1.

All support structures disclosed herein can be used in the container 1 of FIG. 6.

The invention claimed is:

1. A container comprising a container wall, a container opening, a lid, a membrane, and a support structure, wherein:

the lid closes the container opening;

an outer portion of the membrane is directly attached to a portion of an inner side of the container wall, forming an attachment region;

the support structure comprises a support portion and a bearing portion, wherein the support portion is associated with the membrane and the bearing portion is associated with the lid, the support structure comprises at least one predetermined breaking point, configured as material weakening designed to break when a consumer opens the lid, to separate lid and support structure, and the lid and support structure are formed integrally.

2. The container according to claim 1, wherein the support portion contacts the membrane.

3. The container according to claim 1, wherein the support portion does not contact the membrane.

4. The container according to claim 1, wherein the support portion contacts the membrane such that a force is exerted on the membrane by the support portion.

5. The container according to claim 1, wherein a gap is present between the support portion and the outer portion of the membrane.

6. The container according to claim 5, wherein the gap has a length of less than 20 mm.

7. The container according to claim 1, wherein the support portion is annular in shape.

8. The container according to claim 1, wherein the support portion is cohesively connected to the bearing portion.

9. The container according to claim 1, wherein the bearing portion is connected to the lid.

10. The container according to claim 1, wherein the bearing portion comprises a bearing element that is bar-shaped.

11. The container according to claim 10, wherein the lid comprises a snap element into which an upper portion of the bearing element is snapped.

12. The container according to claim 1, wherein the membrane comprises a membrane bottom having a top side and the support portion comprises a support-portion bottom side, wherein an axial height between an axial reference height and the support-portion bottom side is less than or equal to an axial height between the axial reference height and the top side of the membrane bottom.

13. The container according to claim 12, wherein the axial reference height corresponds an axial height of the lid or to an axial height of a container edge of the container.

14. The container according to claim 1, wherein a force acting on the membrane in the axial direction is partially accommodated by the support portion.

15. The container according to claim 1, wherein a force acting on the membrane in an axial direction is diverted by the support portion thereby a resulting force acting in the attachment region between the membrane collar outer portion of the membrane and the portion of the inner side of the container having a shearing component that is greater than a peeling component.

16. The container according to claim 1, wherein an object is disposed between the lid and the membrane.

17. A method for manufacturing a filled container, comprising the steps of:

providing a container of claim 1, filling a solid or liquid filling material into the opening provided opposite to the lid; and closing the opening provided opposite to the lid, thereby providing the filled container.

18. A method for filling a container closed by a foil membrane on one side, comprising the steps of:

providing a container of claim 1; and filling a filling material into the opening provided opposite to the lid, the filling material falling on the membrane, providing an emerging force in the membrane, wherein the support portion of the support structure diverts the emerging force to the attachment region mainly as a shearing force component.

19. The method according to claim 17, wherein the container is a metallic container.

20. The method according to claim 18, wherein the container is a metallic container.

21. The container according to claim 1, wherein the container is a metallic container, and wherein the container wall is a metallic container wall.

22. A container comprising a container wall, a container opening, a lid, a membrane, and a support structure, wherein:

the lid closes the container opening;

an outer portion of the membrane is directly attached to a portion of an inner side of the container wall, forming an attachment region;

the support structure comprises a support portion and a bearing portion, wherein the support portion is associated with the membrane and the bearing portion is associated with the lid, wherein the support portion is annular in shape, wherein the support portion comprises an outer support ring and an inner support ring, and wherein the outer and inner support rings are connected by a plurality of support bars.

23. The container according to claim 22, wherein the plurality of support bars are distributed in a circumferentially equidistant manner.

* * * * *